US005574669A

United States Patent [19]

Marshall

[11] Patent Number: 5,574,669

[45] Date of Patent: Nov. 12, 1996

[54] DEVICE FOR MEASURING FOOT MOTION AND METHOD

[76] Inventor: William R. Marshall, 2021 Downing St., Greensboro, N.C. 27410

[21] Appl. No.: 377,692

[22] Filed: Jan. 25, 1995

Related U.S. Application Data

[63] Continuation of Ser. No. 68,857, May 28, 1993, abandoned.

[51] Int. Cl.[6] ..... A63B 71/02; A63B 67/00

[52] U.S. Cl. ..... 364/569; 364/565; 73/865.4

[58] Field of Search ..... 364/550, 565, 364/561, 569, 410; 377/20; 73/488, 489, 490, 510, 865.4, 172, 379.04, 379.01; 434/251, 187; 324/178, 180, 161, 166; 368/2, 3, 245, 110–113, 223–225; 482/3; 346/18; 273/445, 446, 440

[56] References Cited

U.S. PATENT DOCUMENTS

| | | | |
|---|---|---|---|
| 3,580,083 | 5/1971 | Zipser | 73/865.4 |
| 4,337,529 | 6/1982 | Morokawa | 377/20 |
| 4,627,620 | 12/1986 | Yang | 273/446 |
| 4,645,458 | 2/1987 | Williams | 273/446 X |
| 4,998,727 | 3/1991 | Person | 273/446 X |
| 5,469,740 | 11/1995 | French et al. | 73/379.04 |

*Primary Examiner*—Emanuel T. Voeltz
*Assistant Examiner*—M. Kemper

[57] ABSTRACT

A device and method of measuring the speed of an object such as a foot is provided which can accurately determine lateral or other movements. The device employs optical sensor circuits which determine object impact on a pair of separate, spaced pads. Electrical circuitry includes a micro-controller which directs signals to an LCD display and a speaker for audio interpretation for the test subject.

8 Claims, 4 Drawing Sheets

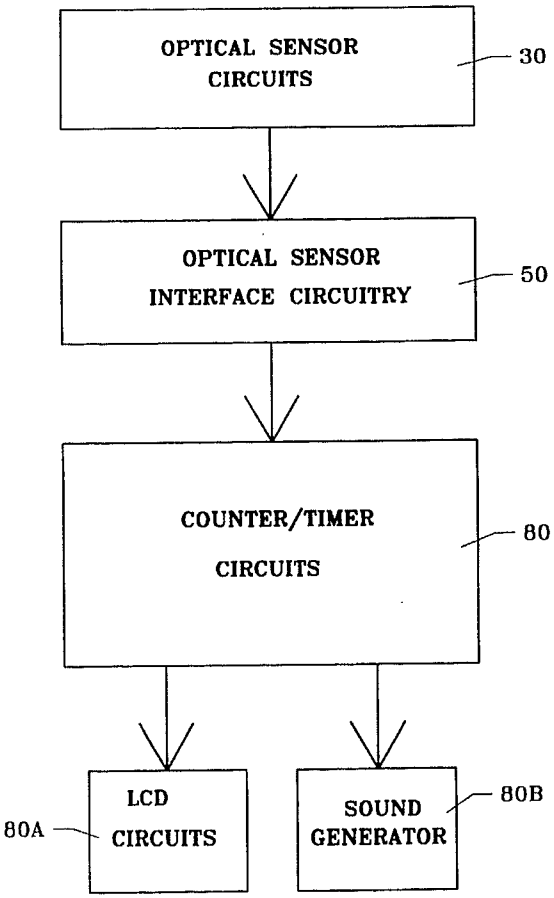
FIG. 3
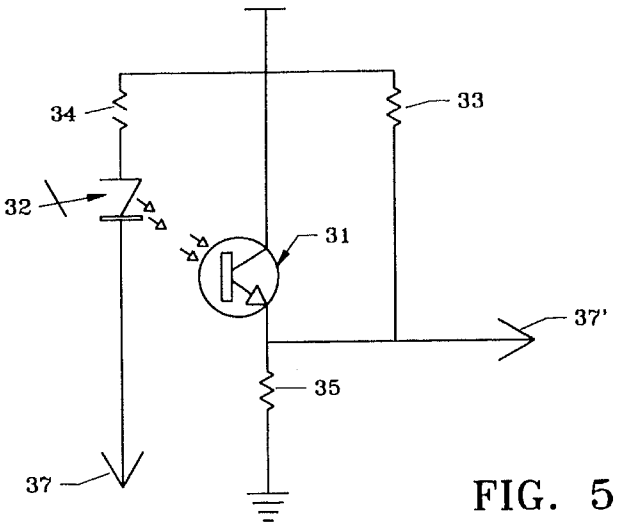
FIG. 5
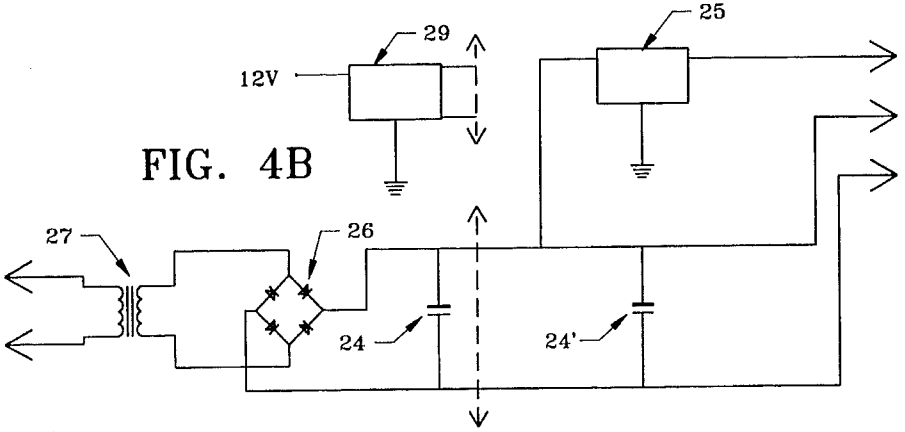
FIG. 4B
FIG. 4A

DEVICE FOR MEASURING FOOT MOTION AND METHOD

This is a continuation of patent application Ser. No. 08/068,857 filed 28 May 1993, now abandoned.

BACKGROUND OF THE INVENTION

1. Field of the Invention

The invention herein pertains to a device and method for measuring foot speed of athletes and the like. The device is particularly concerned with the speed of the lateral and other step motions as may be necessary to excel in football, soccer and other athletic events.

2. Description of the Prior Art and Objectives of the Invention

In recent years, sophisticated methods have been developed and used in training athletes and testing their physical abilities. Most athletes are required to have good running speeds as necessary in track events. However, in certain games such as football and soccer, the athlete's ability to move laterally and change directions quickly is of paramount importance. Football lineman must have the ability to rapidly change direction from left to right and back again. Also, football players need to have the ability to stop instantly, back up and quickly move forward. While the player's ability to run fast in a forward direction is important, it can be equally or even more important to laterally move and change directions quickly.

Various jogging devices have been developed in the past such as set forth in U.S. Pat. No. 3,834,702 whereby game pieces representing runners and a display is connected to a foot mat which senses the motion of the jogger as he runs in place on the mat. Other devices have been developed in the past which are inserted in the runner's shoes to sense the impact as the shoes contact the ground during each stride. Signals generated by each step are in turn transmitted to a receiver and computer display as set forth in detail in U.S. Pat. Nos. 4,763,287 and 4,956,628. While these prior art devices are useful, they do not have the ability to measure an athlete's lateral motion or step quickness when the athlete moves from side to side a prescribed distance and each runner must have shoes designed to fit his particular feet.

With the shortcomings and disadvantages apparent of such known devices, the present invention was conceived and one of its objectives is to provide a device and method for accurately measuring the foot speed of an athlete.

It is still another objectives of the present invention to provide relatively simple electronic circuitry which will allow lateral or other foot speed to be measured, compared and displayed.

It is still another objective of the present invention to provide a device for measuring foot speed which includes a plurality of individual foot pads for use with any size shoes which can be separated a selected distance depending on the size or height of the particular athlete and the test or measurement requirements.

It is still another objective of the present invention to provide a device having electronic circuitry which will allow the athlete to visualize a numerical representation of his speed during measurement while an audio signal provides information relative to the increase or decrease of his speed by pitch variation.

Various other objectives and advantages of the present invention will become apparent to those skilled in the art as a more detailed presentation is set forth below.

SUMMARY OF THE INVENTION

A device and method for measuring foot speed allows the realization of the aforementioned objectives by utilizing a pair of foot pads having optical sensor circuits therein which are joined to electrical circuitry within a housing which can be positioned on a table, desk or the like. The optical sensor circuits sense foot impact and the housing includes a liquid crystal diode (LCD) which permits the test subject or trainer to instantly observe the on-going results of the particular test while an audio speaker emits a beep at specified time intervals. The beep will vary in pitch, depending on the velocity of the athlete's motion. The athlete can be tested by laterally spacing the individual foot pads at greater distances or depending on the test, the individual foot pads can be placed in linear alignment. The electronic circuitry also includes optical sensor interface circuitry, counter/timer circuitry, a visual output display in the form of liquid crystal diodes and sound generating circuitry as mentioned above.

The method of measuring foot speed allows the athlete to move, for example one foot from one foot pad to the other and back in rapid succession for a prescribed time. The speed or time between contacting one pad to contact with the other is counted, stored and compared for a prescribed number of steps and the average time is then displayed. A speaker provides an audio signal with an increasingly high pitch if the speed is increasing, i.e., time between steps decreasing, and by a lower pitch if the speed decreases, i.e., the time between steps increases.

BRIEF DESCRIPTION OF THE DRAWINGS

FIG. 3 depicts a block diagram of the electrical circuitry of the invention;

FIG. 4A illustrates an electrical schematic view of the power source;

FIG. 4B shows another embodiment of the power source utilizing an AC convertor;

FIG. 5 pictures a single optical sensor circuit as used in the invention;

DESCRIPTION OF THE PREFERRED EMBODIMENT

The preferred method of the invention includes a process for determining the lateral foot speed of an individual athlete utilizing the apparatus herein by spacing two foot pads a prescribed distance from one another while maintaining them in a side-by-side relation. The athlete or test subject places a first foot such as the left foot on the right foot pad while maintaining his right foot on the floor therebehind. Once the left foot is placed on the right foot pad the optical sensor circuits within the foot pad senses this impact and a signal is delivered to the microcontroller where this time is stored in the circuitry memory. The test subject then moves his left foot from the right foot pad to the left foot pad (which also contains optical sensor circuits) and he repeats this activity a preselected number of times and/or minutes as rapidly as possible. A liquid crystal diode numerically displays his average speed for a set number of steps while a "beep" is emitted which increases in pitch as his speed increases and decreases in pitch as his speed decreases. His average speed for a selected time period can be permanently recorded by the trainer and compared to other test subjects.

Figure 6:
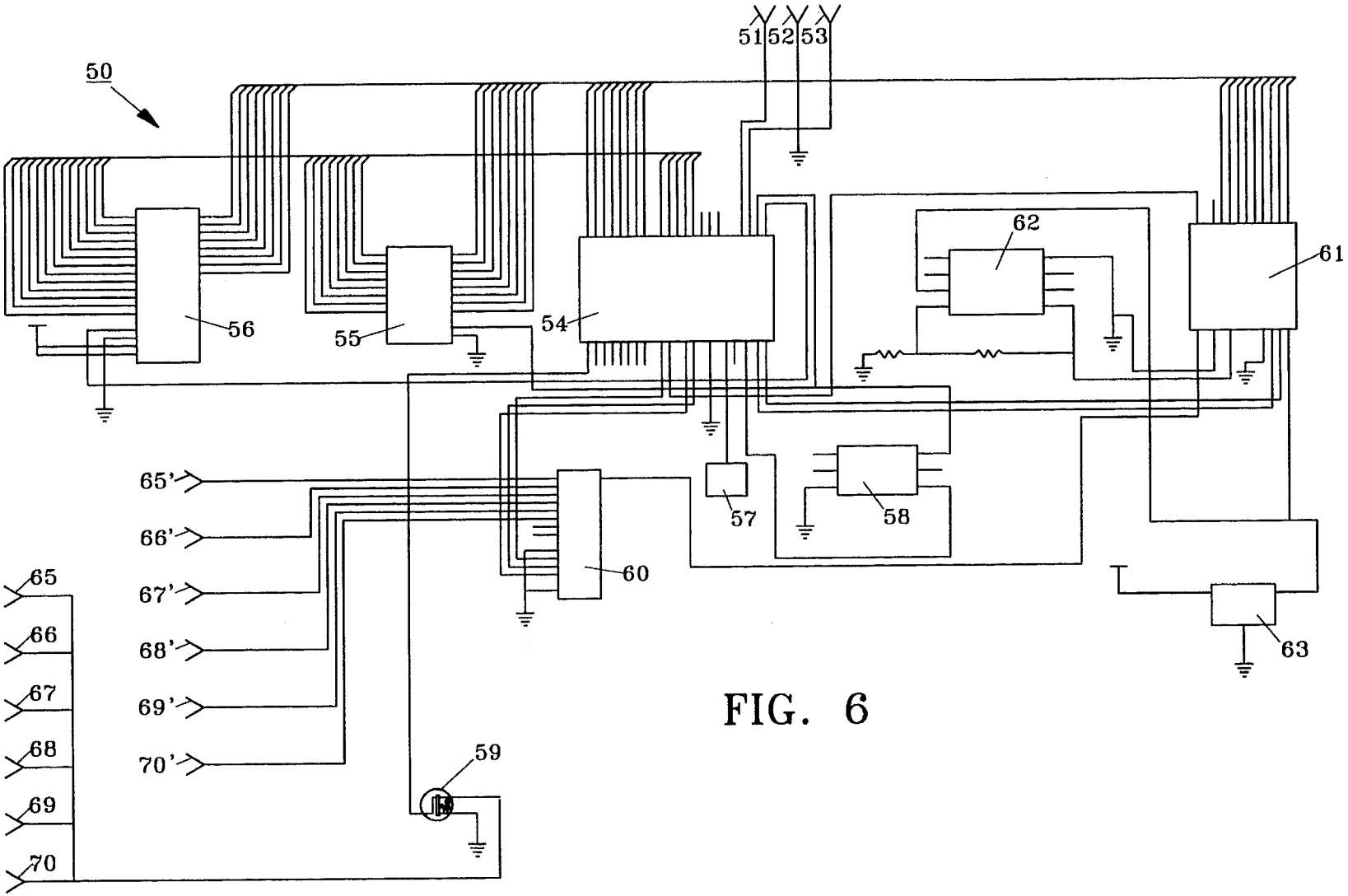
FIG. 6 provides a schematic illustration of the optical sensor interface circuitry.
Figure 7:
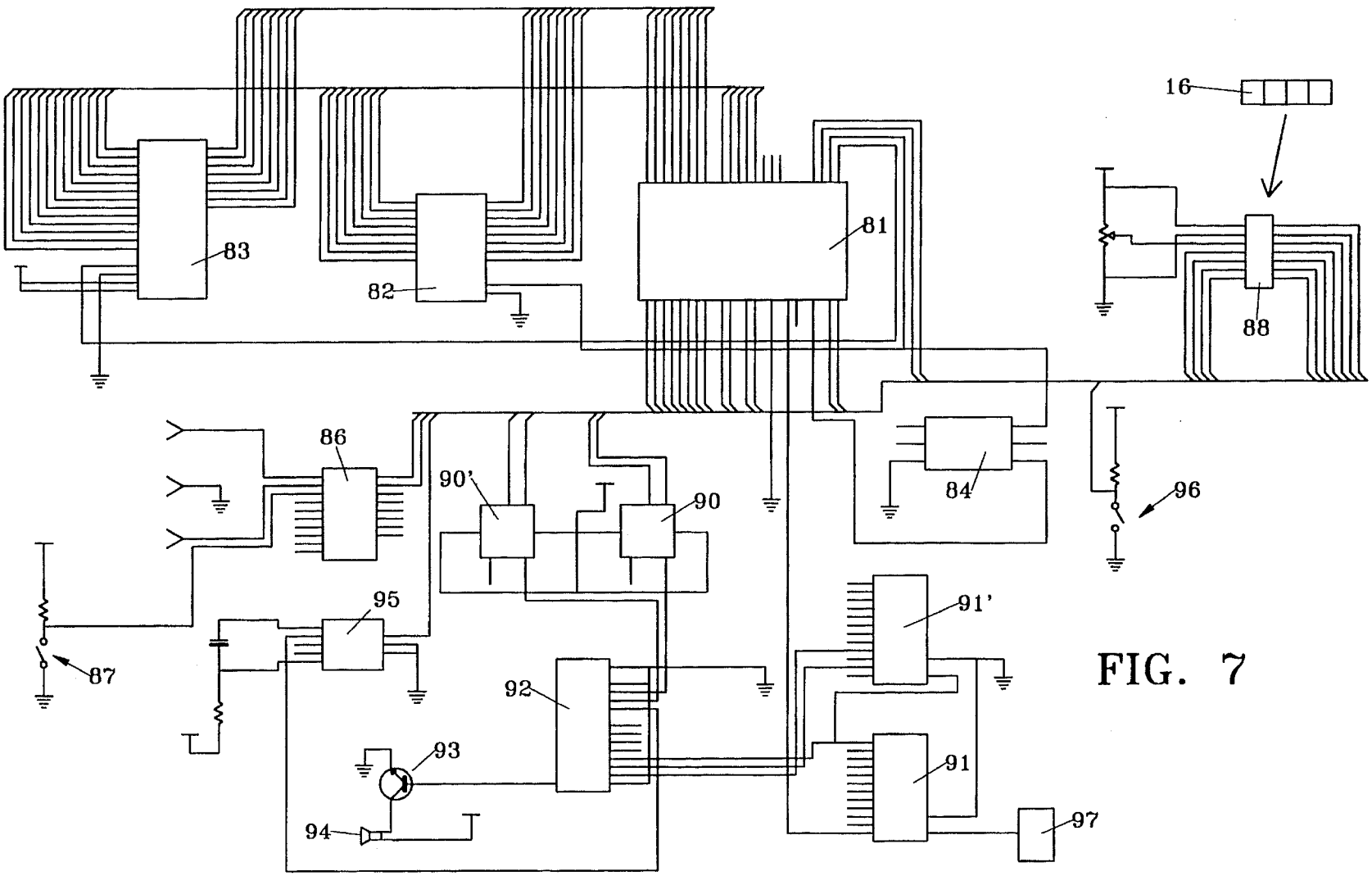
FIG. 7 shows the counter/timer circuitry.

The preferred apparatus of the invention is shown schematically in FIGS. 3–7. Three optical sensor circuits as illustrated in FIG. 5 are positioned in each foot pad. The optical sensor circuits are connected to interface circuitry shown schematically in FIG. 6 which is cable connected to counter/timer circuitry as seen in FIG. 7. Signal transmission from the optical sensor circuits provide an LCD output and sound generation for visual and audio recognition of the quickness or speed of the particular athlete being tested.

DETAILED DESCRIPTION OF THE DRAWINGS AND OPERATION OF THE INVENTION

Figure 2:
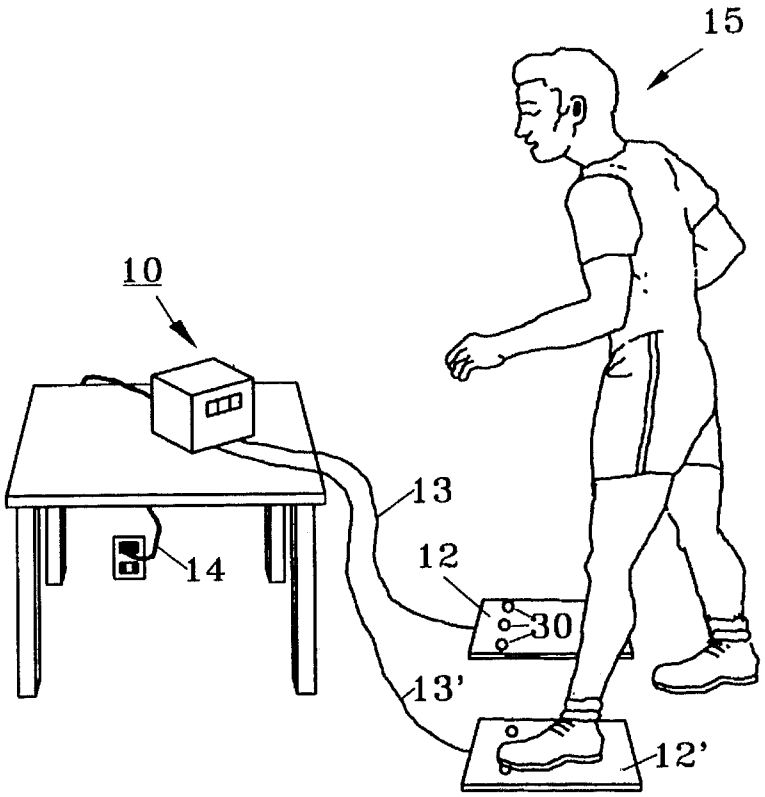
FIG. 2 demonstrates the embodiment as shown in FIG. 1 with the left foot of the athlete moved from the original position on the right foot pad to the left foot pad.
Figure 1:
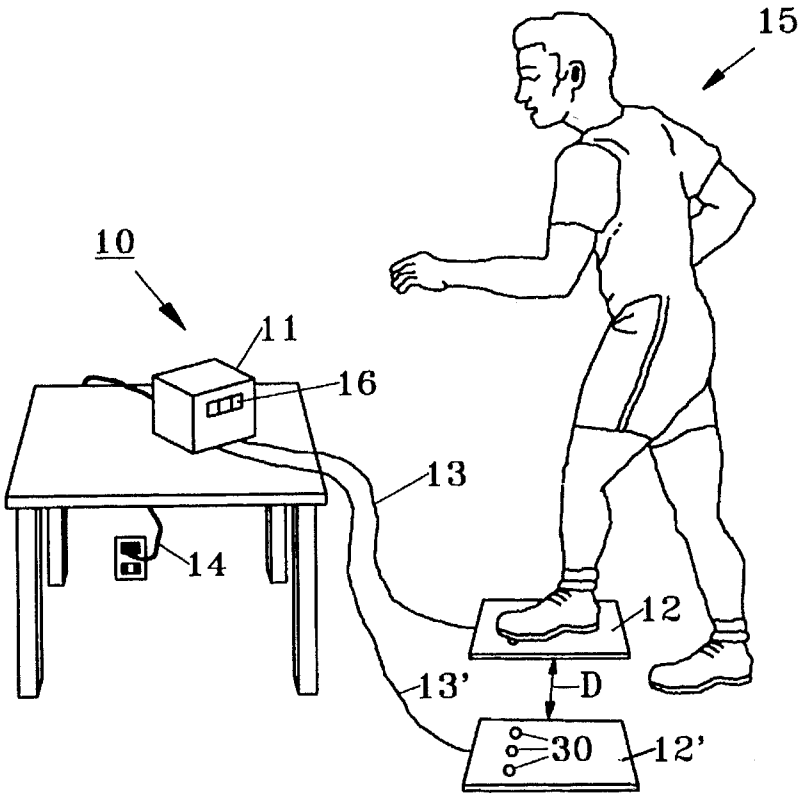
FIG. 1 illustrates the invention as used by an athlete in measuring left foot lateral speed.

For a better understanding of the invention and its method of use, turning now to the drawings, as shown in FIG. 1, foot speed measuring device 10 includes electrical circuitry 20 (FIG. 3) contained partially within housing 11 which is connected to individual foot pads 12, 12'. Other objects such as the hands, arms or otherwise could also be tested. Foot pads 12, 12' are connected to electrical circuitry 20 by cables 13, 13' respectively. 110 V AC is provided through cord 14. To test subject 15, circuitry 20 is turned on by switch 96 (FIG. 7) and subject 15 moves his left foot as shown in FIG. 1 from an original position on foot pad 12 to foot pad 12' continually in rapid succession while the speed in numerical display can be visualized by LCD 16 shown mounted on housing 11. As would be understood, from FIGS. 1 and 2, foot pads 12, 12' can be spaced further apart laterally or closer together as known distance "D" is set, but can be varied, depending on the particular type of test required and the size (height) of the particular test subject. As also would be understood, foot pads 12, 12' can be placed in any particular arrangement such as shown in FIGS. 1 and 2 (side-by-side relation) or they can be placed in linear, diagonal or other alignment desired since they are not joined to each other, or otherwise except by flexible cables 13, 13'. Tests can be developed for various positions and set spaced distances of foot pads 12, 12'. (As used herein laterally refers to the side of a test subject, linear to the front, and diagonal to any angle between lateral and linear.)

In certain games and athletic events, it is extremely important for an athlete to have quick lateral motion and the ability to change direction quickly. This ability can be accurately measured by testing the speed in moving a foot, for example, a left foot from a start position a certain distance to the side and then back to its original position. Linemen in football must have the ability to move laterally and change directions quickly in order to avoid blocks by opposing players. Foot speed measuring device 10 can thus test a series of players and help coaches and trainers make determinations in using particular players in actual games to the greatest advantage of the team.

As subject 15 (FIGS. 1 and 2) moves his left foot from pad 12 multiple optical sensor circuits 30 (See FIGS. 3–5) therein are turned off and like optical sensor circuits 30 in foot pad 12' as shown in FIG. 2 are then turned on as the foot contacts and conceals one or more LEDs 32 therein. It has been found that three such sensor circuits 30, equally spaced and separated approximately two inches (on each foot pad 12, 12') have been satisfactory for most tests. As would be understood, other numbers of sensor circuits 30 could be utilized to sense foot impact if desired, depending on the particular size and shape of foot pads 12, 12'.

As illustrated in FIG. 5, optical sensor circuits 30 include a phototransistor 31 and a light emitting diode 32. 15K ohm resistor 33, 100 ohm resistor 34 and 10K ohm resistor 35 are also shown in FIG. 5 as part of circuit 30. The absence of a foot on either of pads 12, 12' is sensed by optical sensor circuits 30 when switch 96 (FIG. 7) is on. Light from LED 32 which is controlled by resistor 34 bounces off the bottom of the foot and falls on phototransistor 31. The output of phototransistor 31 is proportional to the amount of light falling thereon and the output current of phototransistor 31 is converted to a voltage by resistor 35. Resistor 33 offsets the output of phototransistor 31 from zero volts. If the output were allowed to approach zero volts, then electrical circuitry noise would cause errors and by moving the output away from zero volts, the effect of the noise is greatly reduced.

Optical sensor circuits 30 as depicted (in block form) in FIG. 3 in plural are joined to optical sensor interface circuitry 50 shown in detail schematically in FIG. 6. Optical sensor interface circuitry 50 can also be contained within housing 11 as seen in FIGS. 1 and 2. Interface circuitry 50 reads the outputs of optical sensor circuits 30 and determines if an object, (e.g., a foot) is being sensed by any of the sensor circuits 30, combines the determined results into two outputs and passes the output signals along to counter/timer circuitry 80 as schematically shown in FIG. 7. Optical sensor interface circuitry 50 as shown in FIG. 6 is connected to counter/timer circuitry 80 by connectors 51, 52 and 53. Microcontroller 54 consists of a conventional 8031 or 80C31 chip which is available from Intel or other manufacturers. Microcontroller 54, latches 55, eprom 56, clock oscillator 57, and integrated circuit 58, all conventional components provide control computer circuitry. Power MOSFET transistor 59 turns LEDs 32 in optical sensor circuits 30 on and off whereas data selector 60 is used to select which optical sensor circuits 30 interface circuitry 50 is reading at any given time. A-D convertor 61 changes the voltage output of the selected optical sensor circuits 30 to a digital number which microprocessor 54 can utilize. Voltage reference 62 supplies a reference voltage to A-D convertor 61 and voltage regulator 63 supplies power to A-D convertor 61 and voltage reference 62.

A schematic power source 25 is seen in FIG. 4A for supplying 12 V DC voltage to circuitry 20 as seen in FIG. 3. AC converter 29 is pictured in FIG. 4B which can be used in place of 12 V transformer 27, bridge rectifier 26 and 1000 microfarad capacitor 24. Capacitor 24' is rated at 100 microfarads.

Using MOSFET transistor 59, microcontroller 54 turns LEDs 32 in sensor circuits 30 off. Microcontroller 54 then causes data selector 60 to choose the output from one of the sensor circuits 30. This output is sent to A-D convertor 61 which converts it to a digital number and microcontroller 54 then causes this number to be stored. The other sensor circuits 30 present are read in a similar fashion.

Microcontroller 54 can also turn on sensor circuit LEDs 32 whereupon the information is read and stored as described above. Microcontroller 54 also causes a comparison to be made at outputs 37 and 38 as shown in FIG. 5. If the output with LED 32 turned on is greater than the output with LED 32 off by a preset margin, microprocessor 54 notes that the particular optical sensor circuitry 30 is blocked. This preset margin provided is used to help circuitry 10 ignore erroneous results. If the output with the particular LED 32 on is not greater than the output with that LED off, then that sensor circuitry 30 is considered clear by microcontroller 54.

In the preferred embodiment as shown in FIGS. 1 and 2, three optical sensor circuits 30 are used in each foot pad 12, 12'. If the first, second or third sensor circuit 30 in foot pad 12 is blocked, then pin 40 of microcontroller 54 is driven active. If any of the three optical sensor circuits 30 of foot pad 12' are blocked, then pin 41 of microprocessor 54 is driven active. As would be further understood, connectors 65, 65' join outputs 37, 37' of optical sensor circuit 30 as shown in FIG. 5. Connector 66, 66' would likewise connect to a second optical sensor circuitry 30 as seen in FIG. 6, and connectors 65–75 and 65'–75' are connected to a plurality of six identical optical sensor circuits 30 as seen in FIG. 5.

Counter/timer circuitry 80 measures the duration of the signals coming from optical sensor interface circuitry 50 and communicates the results to the user by both visual and audio means as explained in more detail below. Referring to FIG. 7, microcontroller 81 along with latches 82, eprom 83 and intergrated circuit 84 provide signal control circuitry. Programmable logic 86 and toggle switch 87 control the timing modes. Cable connector 88 is used to send data to liquid crystal diode 16 as shown in FIGS. 1 and 2. LCD circuitry 80A which includes LCD 16 is used to numerically show the timing data to the operator or to test subject 15. Flip-flops 90, 90', counters 91, 91', data selector 92, transistor 93, speaker 94 and multivibrator 95 form sound generator 80B (FIG. 3) so the user can listen to "beeps" to understand the progress or change in his speed while undergoing the test. A higher pitch beep indicates a faster pace whereas a lower pitch beep indicates a slower pace.

As it is important to measure the time that a subject's foot requires to leave one foot pad until it makes contact again, two counting modes are available, selected by the position of toggle switch 87. One mode is intended to measure foot speed while running in place. For this mode the length of time is measured from the foot leaving the pad (as determined by optical sensor circuit 30) until it activates optical sensor circuit 30 of the same pad from which it is removed. Therefore, in this mode each foot pad 12, 12' is timed and displayed separately by LCD 16.

In the second mode, moving only one foot, device 10 measures the time beginning once a foot leaves the first pad until it contacts the second foot pad. This two pad usage would occur when, for example measuring the speed of the subject's lateral movement.

The logic which determines and controls these two different modes is programmed into programmable logic 86. The output of programmable logic 86 comprises two signals which are available to microcontroller 81. Microcontroller 81 begins a timing cycle when either of the two aforementioned logic signals become active and it is terminated when the respective signals become inactive. This time (of active to deactive logic signal) is stored in memory. When as preselected, eight times are stored for a different input, microcontroller 81 calculates the average time for that particular series of eight inputs. Microcontroller 81 then sends that time average to LCD 16. Microcontroller 81 also compares that time period average with the last time period average of eight times. If the time period average is shorter (faster) it causes speaker 94 to emit a high pitch beep. If the time average is about equal to the last time period a medium pitch beep is emitted. If the time average is slower a longer (slower) lower pitched beep is emitted. The average time is then stored for comparison with the next time average, the earlier stored times are cleared and counter/timer circitry 80 awaits for the next signal. The two inputs are again timed, stored and compared as described above. Sound frequencies are generated by counters 91, 91' which are counter/frequency dividers. Dual flip-flops 90, 90' store either of the three frequencies to be selected. Multi-vibrator 95 controls the length of the beep which is about one-tenth of a second. Data selector 92 passes the frequency selected by microprocessor 81 (and flip-flops 90, 90') for the length of time determined by multi-vibrator 95 to transistor 93 and speaker 94. Other components shown in counter/timer circuitry 80 include on/off switch 96 and clock oscillator 97.

Changes and modifications can be made to the various circuits and components shown and the illustrations and examples provided herein are for explanatory purposes and are not intended to limit the scope of the appended claims. Also, while the examples herein generally refer to the testing of foot speed, other objects can be timed or tested such as arms, hands or otherwise.

I claim:

1. A device for timing a moving subject comprising: a first separately movable pad, said first pad comprising means for sensing the presence of the subject contiguous thereto, a second separately movable pad, said second pad comprising means for sensing the presence of the subject contiguous thereto, said first pad sensing means and said second pad sensing means for sensing the presence of the subject contiguous thereto, each of said pad sensing means comprising a separate optical sensor circuit, each of said optical sensor circuits comprising a light source and a light sensor, said light source comprising a light-emitting diode, said light sensor comprising a photo transistor, said light-emitting diode and said photo transistor positioned so that light emitted from said diode and reflected by said subject controls the output current of said photo transistor, electrical circuitry, said electrical circuitry comprising a means for measuring a time interval, means for displaying said time interval, said means for displaying said time interval comprising means for generating a sound, said sound generation means for audibly indicating said time interval, said sound generation means comprising means for generating a sound of variable pitch, said variable pitch sound generation means comprising a flip,flop, said flip-flop for storing the pitch of the sound to be generated, a multi-vibrator, said multi-vibrator connected to said flip-flop, said multi-vibrator for controlling the duration of the sound to be generated, said variable pitch sound generation means for generating a high-pitched sound when said time interval decreases, said variable pitch sound generation means for generating a low-pitched sound when said time interval increases, said time interval displaying means connected to said electrical circuitry, a first flexible cable, said first flexible cable joined to said sensing means of said first pad, a second flexible cable, said second flexible cable joined to said sensing means of said second pad, said first and second flexible cables independently connected to said electrical circuitry and allowing separate movement of said pads to vary the distance therebetween, wherein the time interval between the sensing of the subject contiguous said first pad and the sensing of the subject contiguous said second pad can be displayed.

2. The device of claim 1 wherein said first pad is a separately movable floor positioned foot pad and said second pad is a separately movable floor positioned foot pad.

3. A method of timing the movements of a subject with a device having first and second separately movable electronic sensing pads, connected to electrical circuitry, said electrical circuitry having timing and display circuits, said electrical circuitry independently joined with said first separately movable electronic sensing pad and said second separately movable electronic sensing pad, the method comprising the steps of:

(a) spacing said first sensing pad a first desired distance from said second sensing pad;

(b) placing said subject contiguous said first sensing pad;

(c) sensing said subject's presence contiguous said first sensing pad;

(d) electrically communicating said first pad sensing to said timing circuit;

(e) removing said subject from said first sensing pad;

(f) placing said subject contiguous said second sensing pad;

(g) sensing said subject's presence contiguous said second sensing pad;

(h) electrically communicating said second pad sensing to said timing circuit;

(i) measuring the time from said first pad sensing to said second pad sensing with said timing circuit;

(j) displaying the measured time with said display circuit;

(k) averaging a first plurality of said measured times;

(l) storing said first average measured time;

(m) averaging a second plurality of measured times;

(n) comparing said second average measured time to said first average measured time;

(o) emitting a low-pitched electronic sound if said second average measured time is greater than said first average measured time;

(p) emitting a high-pitched electronic sound if said second average measured time is less than said first average measured time;

(q) spacing said first separately movable sensing pad a second and different desired distance from said second separately movable sensing pad; and (r) repeating steps (b) through (j).

4. The method of claim 3 wherein the step of spacing said first sensing pad a first desired distance from said second sensing pad includes the step of positioning said first sensing pad and said second sensing pad on a floor.

5. The method of claim 3 wherein the step of placing said subject contiguous said first sensing pad includes the step of placing a human foot contiguous said first sensing pad.

6. The method of claim 3 wherein the step of sensing said subject's presense contiguous said first sensing pad includes the step of optically sensing said subject's presense contiguous said first sensing pad.

7. The method of claim 3 wherein the step of displaying the measured time with said display circuit includes the step of generating a sound.

8. The method of claim 7 wherein the step of generating the sound includes the step of varying the pitch of the sound.

* * * * *